US005623786A

United States Patent [19]

DeMeyer

[11] Patent Number: 5,623,786

[45] Date of Patent: Apr. 29, 1997

[54] BASE BLOCK WITH REMOVABLE BALLAST FOR PORTABLE TOWER, SYSTEM AND METHOD

[75] Inventor: Hedwig F. H. DeMeyer, Werchter, Belgium

[73] Assignee: Stageco U.S., Inc., Colorado Springs, Colo.

[21] Appl. No.: 342,210

[22] Filed: Nov. 18, 1994

Related U.S. Application Data

[63] Continuation-in-part of Ser. No. 20,681, Feb. 22, 1993, Pat. No. 5,388,376.

[51] Int. Cl.[6] ..... E04H 3/10

[52] U.S. Cl. ..... 52/6; 52/66; 52/123.1; 52/125.1; 52/125.2; 403/79

[58] Field of Search ..... 52/2.25, 126.1, 52/126.6, 6, 66, 123.1, 125.1, 125.2; 248/910; 404/6; 403/79

[56] References Cited

U.S. PATENT DOCUMENTS

| | | | |
|---|---|---|---|
| 2,982,379 | 5/1961 | Fisher | 79/403 X |
| 3,847,488 | 11/1974 | Gossage | 79/403 |
| 3,877,681 | 4/1975 | Humphrey | 404/6 X |
| 3,978,634 | 9/1976 | Mack et al. | 79/302 X |
| 4,512,117 | 4/1985 | Lange | 52/6 |
| 4,569,169 | 2/1986 | Madray | 52/126.1 |
| 4,696,133 | 9/1987 | Wren et al. | 6/52 X |
| 4,712,337 | 12/1987 | Marcusse et al. | 79/403 X |
| 4,862,654 | 9/1989 | Macias | 52/126.1 |
| 4,886,245 | 12/1989 | Manzo | 79/403 X |
| 4,995,204 | 2/1991 | Kelso | 52/126.1 |
| 5,076,031 | 12/1991 | Hancock | 6/52 X |
| 5,088,680 | 2/1992 | Farmer | 248/910 X |
| 5,103,600 | 4/1992 | Geiger et al. | 52/6 |
| 5,205,101 | 4/1993 | Swan et al. | 6/52 X |
| 5,388,376 | 2/1995 | DeMeyer | 52/6 |

FOREIGN PATENT DOCUMENTS 223570 6/1910 Germany .

*Primary Examiner*—Carl D. Friedman
*Assistant Examiner*—Beth Aubrey
*Attorney, Agent, or Firm*—John W. Montgomery; Gardere & Wynne, L.L.P.

[57] ABSTRACT

A base block for use in a system of onsite construction of a tower, comprising a floor, having predetermined dimensions defining a periphery. A perimeter wall is sealingly attached, extending upwardly a predetermined distance around the periphery of the floor so that an enclosed ballast reservoir is formed. Tower connectors are rigidly affixed to the base blocks at predetermined positions for mating removable engagement with the tower.

10 Claims, 11 Drawing Sheets

BASE BLOCK WITH REMOVABLE BALLAST FOR PORTABLE TOWER, SYSTEM AND METHOD

CROSS REFERENCE TO RELATED APPLICATIONS

This is a continuation-in-part application of U.S. patent application, Ser. No. 08/020,681, filed Feb. 22, 1993 now U.S. Pat. No. 5,388,376.

TECHNICAL FIELD OF THE INVENTION

The present invention relates to portable roof and tower systems which may be disassembled and reassembled on location for temporary stage performances; and more particularly, to a roof construction and method in which the resulting roof is covered and stably supported from towers.

BACKGROUND OF THE INVENTION

In recent years, it has become popular to provide musical concerts to large audiences, which audiences will not fit into standard concert hails or theaters because of space limitations. In the case of popular bands or musical performers, such as rock and roll bands or country and western singers, such performances have been provided in large sports arenas, such as baseball, football, or soccer fields, or other spacious outdoor facilities, including beaches or pastures. In order to provide a stage for the set-up of musical instruments and for providing a platform for the performers, such stages had to be constructed on-site from the ground up. Sports facilities, pastures, and beaches which can accommodate the large crowds attending the performances, are not normally equipped with the type of permanent covered stage from which the performers' equipment, including musical instruments, amplified speakers, video screens, lights, pyrotechnics, and other special effects, can be suspended and displayed. Further, because of the sensitivity of much of the equipment, including complex electronic lighting, amplifiers, speakers, video equipment, and the like, to weather conditions, the modern stages must be provided with adequate stable and secure roof coverage. In order to accommodate the complete visual effect of the performance and to allow all aspects of the performance to be viewed from the large audience, the roof must be spaced a substantial distance above the stage platform.

In the past, stage roofs have been constructed with the expenditure of much time and effort using standard building or scaffolding techniques, which to a large extent required extensive bolt tightening or clamping during assembly of the support structure and stage walls. There was a corresponding bolt loosening and clamp loosening during disassembly. Many of the roofs had to be constructed using cranes and workmen atop of the scaffolding or stage walls for long periods of time. Complex construction procedures at the top of the walls were dangerous and time consuming.

In recent years, it has been found that roof assemblies could be more simply and more safely constructed at ground level or at a stage platform level and then raised to above the ground or platform suspended from the top of scaffolding with steel cables. Such construction was less complicated and less time consuming, but nevertheless, necessarily resulted in a less stable roof configuration due to the flexibility of the suspension cables. Excessive tension in the cables, in order to reduce their flexibility, could cause dangerous overloading both of the cables, as well as the stage walls or scaffolding from which the cables were supported.

Many modern live performances often tour from one city to the next to provide the same or similar shows for different audiences at separate locations on such a multi-city or multi-national tour. Each new performance requires that a stage be provided. To the extent that the show relies upon a tower and roof assembly, it is advantageous to have the same tower and roof construction provided at each show for each repeat performance. In order to provide a stable tower and roof system at each location, heavy base blocks are used to form a foundation for the tower and roof assembly at each location. Generally, the heavier the base block, the better for stability purposes; however, each pound of additional weight must be loaded on transport vehicles, transported and unloaded and repositioned between each stage setup between the performances at different locations. In the past, either the base blocks had to be smaller and of lighter weight than most desirable, for safety purposes, or the extra cost for transporting, loading, unloading, handling, positioning and leveling of heavy base blocks had to be incurred between each setup. Also, to keep the size and weight manageable, it was sometimes necessary to provide separate tower pedestals, so be attached to the base blocks. The base blocks, the pedestal and the tower sections were separately of a manageable weight, but additional handling and assembly increased the time and cost of construction at each site.

SUMMARY OF THE INVENTION

The present invention overcomes many of the drawbacks of the prior stage or roof construction systems and methods, by providing a system and method of the type for building, disassembling, moving, and reassembling at an intended site, a covered roof from component pieces. A plurality of movable pairs of base blocks are carefully positioned at predetermined regular spaced apart locations at the intended roof site. A plurality of pedestals are removably fastenable for support from the top of each of the base blocks to form pairs of pedestals at close tolerance adjustable spaced apart locations. A plurality of towers are removably fastenable to and vertically extending upwardly from the plurality of base pedestals to form pairs of spaced apart towers. A plurality of head blocks are removably fastenable at the tops of the plurality of towers to form pairs of spaced apart head blocks. A roof assembly is constructed on-site at ground level or at a stage platform level using a plurality of roof trusses aligned and extending between the opposed ones of the pairs of towers. The constructed roof assembly is then lifted using a plurality of cable winches. Sheaves attached to the head blocks allow ground level winch motors to be used. The opposed ends of the truss sections are fitted with male or female clevis portions and the head blocks are fitted with correspondingly located complementary female or male clevis portions. When the roof assembly is raised to its upward position, the male and female clevis portions on the trusses and the head blocks are matingly engaged for rigid mechanical support.

Another object of this invention is to provide a base block, which can be conveniently filled and emptied of ballast at the building site so that the transportation weight of the base block is substantially reduced. Particularly, the base block can be conveniently filled with water, which water is retained within the confines of the sealed base block for the duration of a performance. The water is drained used specially designed, large drain plugs, which may be removably installed. Preferably, the sealing plugs are constructed so that a minimum amount of machining is required on the base block itself, thereby reducing machining costs and also reducing risk of damage to threads and machine surfaces as might otherwise be a common occurrence during the heavy construction involved with assembling of portable stage roofs.

It is further an object of the present invention to provide a base block, which is provided with clevis fittings positioned in locations corresponding to the dimensions of a tower assembly, or alternatively, a pedestal assembly, so that either the pedestal assembly or the tower assembly may be directly fastened to the portable base block having ballasts addable thereto.

It is a further object of the present invention to provide a base block having a self-contained leveling mechanism, particularly a leveling mechanism having a hand-operated crank device accessible from above the base block so that convenient positioning and leveling is facilitated.

BRIEF DESCRIPTION OF THE DRAWINGS

These and other objects and advantages of the present invention will be more fully understood with reference to the following detailed description, claims, and drawings, in which like numerals represent like elements and in which:

DETAILED DESCRIPTION OF THE PREFERRED EMBODIMENTS

Figures 1, 3:
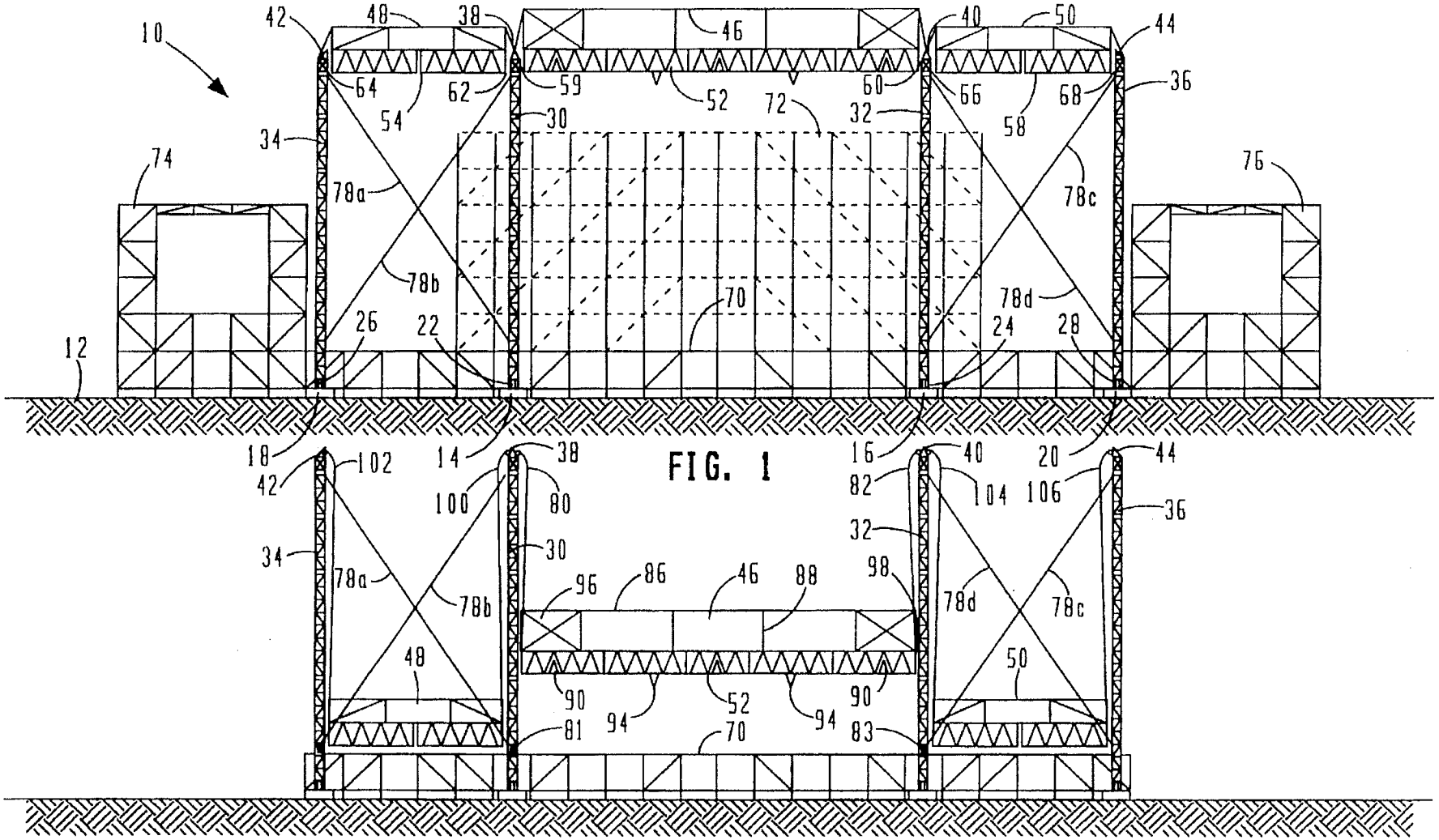
FIG. 1 is a front elevation view of a completed roof and tower system according to the present invention constructed over a stage platform.
FIG. 3 is a front schematic elevation view of a roof and tower system during assembly showing platform level roof assembly construction and unitary raising of roof assemblies from a stage platform level between pairs of towers up to the top of the pairs of towers.

FIG. 1 shows a front elevation view of an assembled roof and tower system construction 10 according to the present invention which can be built on site from ground level 12.

Figure 2:
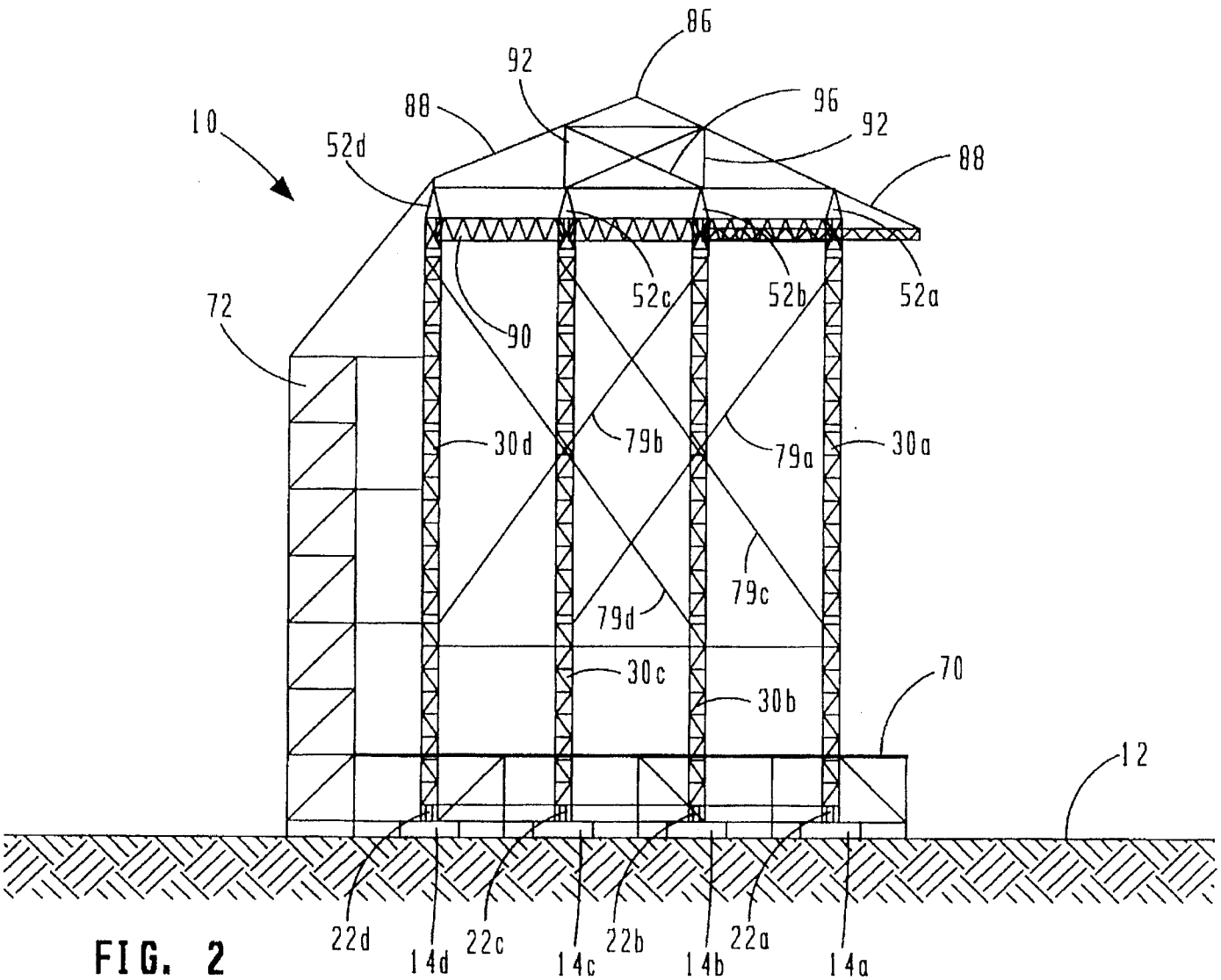
FIG. 2 is a side elevation view of the roof and tower system of FIG. 1.

A plurality of first base blocks 14 are positioned at spaced apart locations from the front to back of the roof and tower system 10. The number of base blocks 14 and a predetermined distance between them determines the front to back depth of the tower system which supports a covered roof. A second plurality of base blocks 16, corresponding in number to the plurality of base blocks 14, are positioned at spaced apart locations from front to back so that each second base block 16 is also spaced to a side and aligned with a base block 14 to form pairs of first and second base blocks 14 and 16 which are at regular side to side locations. The spaced apart side to side distance between each first base block 14 and second base block 16 of each pair determines the width of the roof. For example, this may form a main roof and tower structure for covering a main stage or performance area. Additionally, for versatility and increased roof coverage and equipment protection, a third plurality of base blocks 18 may be positioned at regular spaced locations front to back and spaced apart a predetermined distance on one side of base blocks 14 and a fourth set of base blocks 20 may be positioned at regular locations front to back and spaced apart a given distance on the other side of the plurality of base blocks 16. For example, additional roof and tower structures can advantageously form sound wings adjacent to a main roof and tower construction for a main stage. The number of base blocks 18 and 20 need not be equal to the number of base blocks 14 and 16. However, in the preferred embodiment, base blocks 18 will form additional pairs of aligned base blocks with base blocks 14; and base blocks 20 will form additional pairs of aligned base blocks with base blocks 16. Reference to the side elevation view of the roof structure 10, as shown in FIG. 2, will facilitate understanding of the front to back positioning of the plurality of pairs of base blocks formed by aligned pairs of base blocks 14 and 16.

Returning again to FIG. 1, each of the pairs of the plurality of base blocks 14, 16, 18, and 20, will support a plurality of pedestals 22, 24, 26 and 28. The plurality of pedestals 22 and 24 will form pairs of aligned pedestals 22 and 24. The alignment of each of the pedestals on the base blocks is carefully adjusted, and then each of the pedestals is secured against movement on the top of the base block from which it is supported.

A plurality of towers 30 are removably attached vertically extending from each of the plurality of pedestals 22 and similarly, a plurality of towers 32 are removably attached vertically extending from each of the pedestals 24 so that corresponding pairs of towers 30 and 32 result. Also, pedestals 26 have towers 34 removably attached extending upwardly therefrom and a plurality of pedestals 28 have a plurality of towers 36 removably fastenable extending vertically therefrom. Thus, a plurality of towers 34 will form one side pair of towers with at least some of the towers 30 and a plurality of towers 36 will form another plurality of side pair towers, with some of the towers 32. At the top of pairs of towers 30 and 32, pairs of head blocks 38 and 40 will be affixed. Preferably, the head blocks will be affixed to the towers while they are in a horizontal orientation before they are attached and raised vertically from the pedestals. Similarly, head blocks 42 and 44 will be removably affixed to the tops of towers 34 and 36, respectively. The upper ends of the towers are further steadied against front to back swaying using guy wires 79*a, b, c* and *d* (shown in FIG. 2) to provide triangular tension support between the towers.

A covered roof assembly 46 is secured between the plurality of head blocks 38 and 40. A side roof 48, such as a sound wing roof 48, will be secured between the plurality of other side pairs of head blocks 38 and 42. Another side roof 50, such as a sound wing roof 50, also may be secured between the plurality of side pairs of head blocks 40 and 44. Covered roof assembly 46 is constructed of and supported with a plurality of roof trusses 52 which extend rigidly secured between opposed pairs of head blocks 38 and 40. Similarly, roof assembly 48 used as one sound wing is supported with a plurality of roof trusses 54, rigidly secured between pairs of head blocks 38 and 42 and roof assembly 50 is supported by a plurality of roof trusses 58 removably, yet rigidly connected between head block pairs 40 and 44. Thus, a plurality of roof trusses 52 are connected at one end to head blocks 38 at connection sites 59 and are connected at opposite ends to head block 40 at connection site 60. A plurality of roof trusses 54 are connected to head blocks 38 at connection 62 and to head block 42 through connection 64. A plurality of roof trusses 58 are connected to the plurality of pairs of head blocks 40 and 44 at a plurality of connections 66 and 68, respectively.

Thus, a roof 10 is constructed for covering a desired area, such as a stage platform 70. Stage platform 70 may be constructed with scaffolding in a standard fashion, except that openings for towers 30, 32, 34 and 36 are provided in stage platform 70. Also, background scaffolding 72 may be constructed for supporting displays, background scenery, sound equipment, or special effect devices, or the like. Similarly, additional side display scaffoldings 74 and 76 may be constructed adjacent to a main stage roof structure to provide additional displays, such as video screens, public address systems, or other special effect displays as desired to enhance the performance. Along with fore and aft guy wires 79, the side towers 34 and 36 are further steadied against side to side swaying using the support guy wires 78*a*, 78*b*, 78*c* and 78*d* to provide triangular tension support. As with guy wires 79, the guy wires 78 may be attached as required and in a known fashion for providing sufficient stability for the height of the towers.

Additional features will be understood with reference to FIG. 1, in connection with FIGS. 2 and 3, in which FIG. 2 is a side elevation view of the main roof structure of FIG. 1, and FIG. 3 is a schematic front elevation view during construction. In FIG. 2, multiple pairs of base blocks 14 and 16, multiple pairs of pedestals 22 and 24, and multiple pairs of towers 30 and 32 are shown. A plurality of roof truss sections 52*a, b, c,* and d, from which roof assembly 46 is supported, are shown connected to the head blocks. In FIG. 3, roof assemblies 46, 48 and 50 are shown being constructed at platform level 70 and then raised upwardly with winch cables 80 and 82 at opposite ends. Winch cables 80 and 82 are preferably drawn upwardly, as by ground level winch motors 81 and 83 around a plurality of pulleys or sheaves mounted on head blocks 38 and 40, respectively. Both pluralities of cables 80 and 82 are preferably drawn upwardly at uniform rates of speed so that the pluralities of trusses 52, and thus the entire covered roof 46, are drawn upwardly in a horizontal orientation without undue tilting. Even weight distribution is maintained between a plurality of cables 80 on one side and a plurality of cables 82 on the opposite side. As will be discussed more fully below, head blocks 38 and 40 are uniquely constructed with built-in sheaves, preferably double sheaves, so that the winch motors 81 and 83 can be located at platform level 70 with the cables 80 and 82 extending down through the center portion of towers 30 and 32, respectively (as shown with hidden lines).

Prior to raising the roof assembly 46 as a unitary structure, it is constructed at platform level 70, preferably having a peak along roof ridge pole 86 and roof rafters 88 extending in both directions forward and backward from roof ridge pole 86 down to roof trusses 52*b* and 52*a* in FIG. 2. A plurality of tie beams 90 extending from the frontmost tower to the rearmost tower inserted through openings in truss 52 and clamped to each of the multiple trusses 52. The rafters 88 may be supported with vertically extending queen post 92 upward from tie beams 90 or from trusses 52*b* and 52*c*. Additional struts 96 may also be used. Lighting support trusses 94 may be attached through or below trusses 52 as desired for suspending lights or sound equipment for any particular performance or event. A lightweight waterproof covering, such as a PVC tarp or a reinforced sheet of plastic, is supported by the rafters. Preferably, the covering is both opaque and waterproof to shield both unwanted sunlight and also to prevent rain or other precipitation from directly landing on the covered area, such as the stage platform 70 below. This construction of the roof advantageously keeps the weight of the structure to a minimum.

Similarly, side roof assembly 48 and another side roof assembly 50 may also be constructed at ground level 12 or at platform 70 and subsequently lifted with winch cables 100 and 102 at one side and 104 and 106 at the other side.

Figure 4:
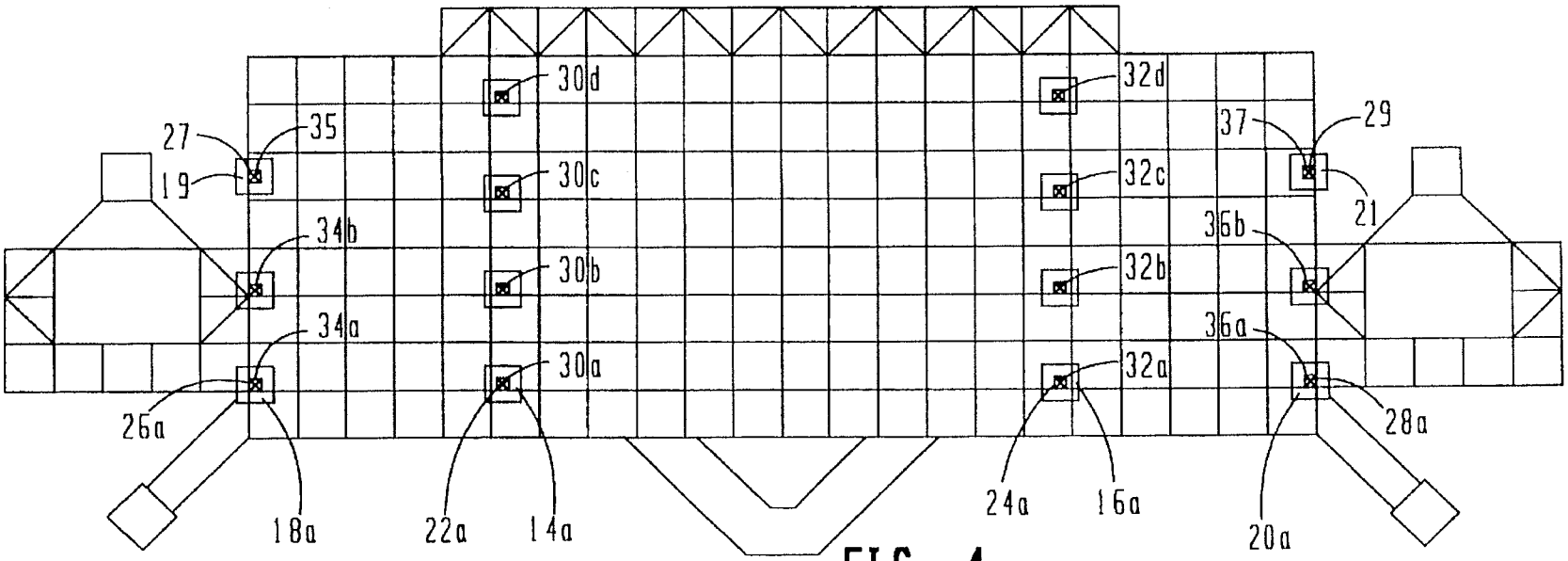
FIG. 4 is a plan view of a stage platform indicating locations of pairs of base pedestals and towers according to the present invention.

FIG. 4 is a plan view of a stage platform 70, showing a plurality of towers, including first, second, third and fourth towers 30(*a–d*), and 32(*a–d*). Also, first and second side towers 34(*a* and *b*) and 36(*a* and *b*) extend upwardly through platform 70. Auxiliary base blocks 19 and 21, pedestals 27 and 29 and towers 35 and 37 which do not necessarily support a roof, may also be constructed.

Figure 5:
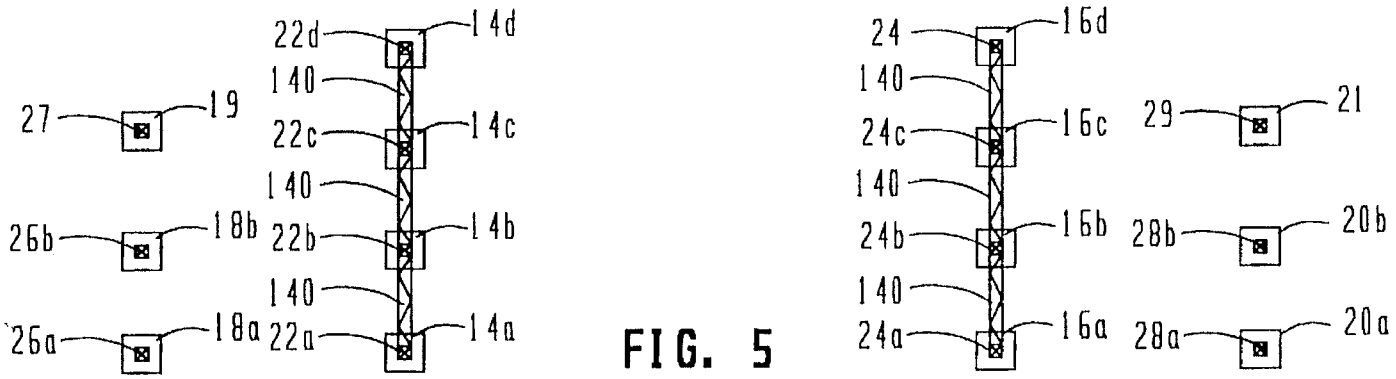
FIG. 5 is a plan view of the positioning of base blocks, pedestals and towers according to the present invention.

FIG. 5 is a plan view of the plurality of first, second, third and fourth base blocks and corresponding pedestals. The layout of these bases and pedestals are the initial steps in the construction of the roof and tower system and must be done substantially accurately through the use of appropriate measuring or surveying equipment. Appropriate positioning of the base blocks is done with forklifts or other types of equipment capable of moving the base blocks which have substantial mass and weight. The layout of the base blocks and the accurate location of the pedestals thereon is important so that the plurality of roof trusses can be removably and rigidly connected to the tops of the resulting towers attached to and located by the pedestals. Pinnable clevis connectors are preferably used for efficient connection when the entire roof assembly is raised up to the head blocks at the top of each of the plurality of towers.

Figure 6:
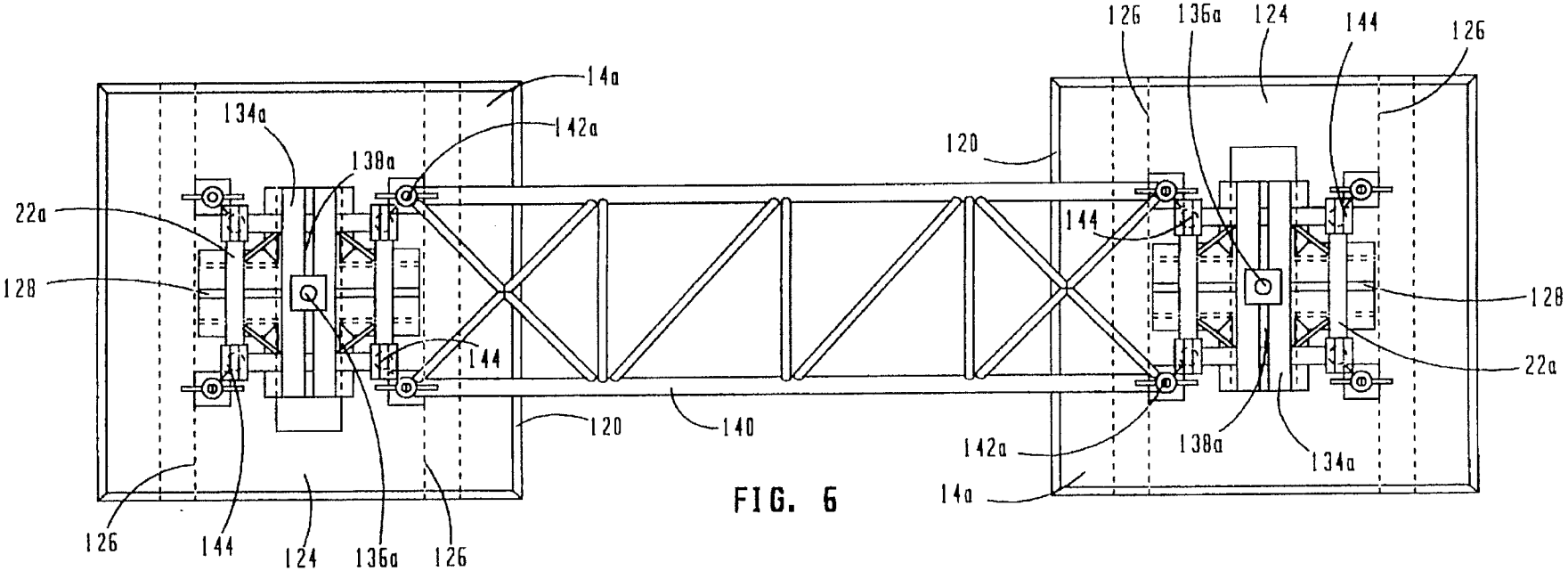
FIG. 6 is a partial plan view of two spaced apart base blocks and pedestals with a positioning truss attached thereto.
Figure 7:
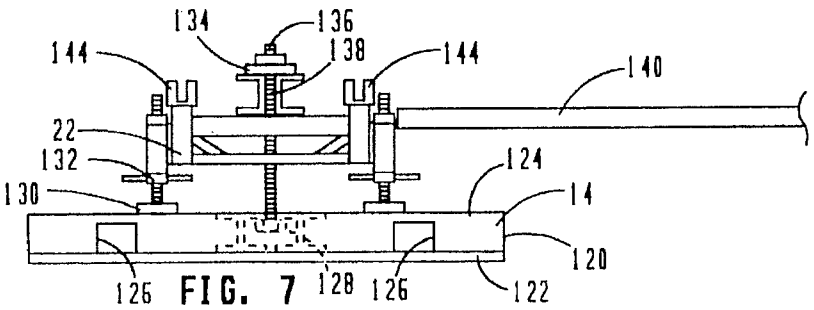
FIG. 7 is a partial side view of a base, a pedestal, and a positioning truss according to the present invention.

The positioning of the first, second, third and fourth plurality of pedestals 22, 24, 26, and 28 will be more fully understood from the explanation below for two pedestals 22*a* and 22*b* and with reference to FIGS. 6 and 7. FIG. 6 is a plan view of two typical base blocks 14*a* and 14*b* of the plurality of base blocks 14, which are typical of all base blocks, with two typical pedestals 22*a* and 22*b* positioned and fastened thereon, which are typical of all pedestals. FIG. 7 is a partial side view of a base block 14 and pedestal 22. Each base block 14*a* and 14*b* is advantageously constructed of a perimeter rim 120 which may be formed of plate material, such as plate steel. A bottom plate 122 interconnects the perimeter rim 120 and is rigidly fastened thereto as by welding. A top support surface 124 is formed interposed between rim 120. The top support surface 124 may be conveniently formed by filling a cavity formed by rim 120 and bottom plate 122 with reinforced concrete to give the base block 14 sufficient mass and durability for stably supporting each tower. Alternatively, the top support surface of a base block may be formed of a plate of steel and the cavity between the top and bottom may be filled with sand, water, or another containable heavy material to provide the desired mass weight for the base blocks.

In order to facilitate movement of the substantially massive base blocks 14, they are formed with forklift channels 126 extending substantially therethrough. Further, to facilitate alignment and accurate positioning of each pedestal 22*a* and 22*b* shown in FIG. 6, the top surface 124 has a cross channel 128 formed therein. For example, cross channel 128 can be constructed of steel I-beams formed in four corner L-shapes which are imbedded into a reinforced concrete material forming top surface 124, or otherwise affixed, so that a cross shape open channel 128 remains in top surface 124.

Pedestal 22 is supported on top surface 124 with feet 130, each of which are fastened to pedestal 22 for adjusting the height of the pedestal with height adjustment means 132 which may be a threaded rod and rotating nut arrangement affixed through tubes 133 to pedestal 22.

Each pedestal 22*a* and 22*b* is regularly located a fixed distance from the other as determined by horizontal two dimensional truss 140. Truss 140 may be clamped to the pedestals 22*a* at 142*a* and to pedestal 22*b* at 142*b* so that the distance and angular orientation or alignment between each of the pedestals 22*a* and 22*b* is precisely controlled because of the fixed length of truss 140. Each pedestal 22*a* and 22*b* is laterally movable on top surface 124 for fine positioning adjustment. When properly positioned, the pedestals are clamped in position using beams 134*a* and 134*b*, respectively, and threaded rods 136*a* and 136*b* therethrough.

Adjustable nuts on either end of each threaded rod 136 allow it to extend from channel 128 to above beam 134 through an elongated opening 138 in beam 134 and to be tightened at any desired height, as established through the adjustment of feet 130. Cross channel 128 allows the threaded nut and rod arrangement 136 to move in either of two directions so that uniform clamping is accomplished to fasten pedestals 22 in the precisely desired position.

It will be understood by those skilled in the art with reference to the preceding FIGS. 1–5, that pedestals 22*a* and 22*b* and base blocks 14*a* and 14*b* form pairs of pedestals and bases with opposed bases 16*a* and 16*b* and opposed pedestals 24*a* and 24*b*, each of which are spaced apart with an identical two dimensional truss member 140 so that the alignment and spacing of each of the pairs is accurately established. Additional base blocks 14*c* and 14*d* and pedestals 22*c* and 22*d* (shown in FIG. 5) are also connected aligned with spacing truss members 140 to provide uniform fore and aft spacing of the pedestals.

It will be noted with reference specifically to FIG. 7 that female clevis connector portions 144 extend upwardly from each corner of pedestal 22 in order to receive corresponding male clevis portions at the bottom of tower sections 30. (The arrangement could be reversed provided mating clevis portions result.) Thus, by accurately positioning each of the plurality of pedestals 22 and each of the corresponding opposed pedestals 24 of each aligned pair of pedestals, as well as the other base and pedestal assemblies, each of the plurality of towers 30, 32, 34 and 36 is also precisely located.

Figure 10:
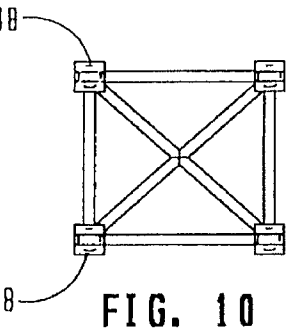
FIG. 10 is a plan view of the tower section of FIG. 8.
Figure 9:
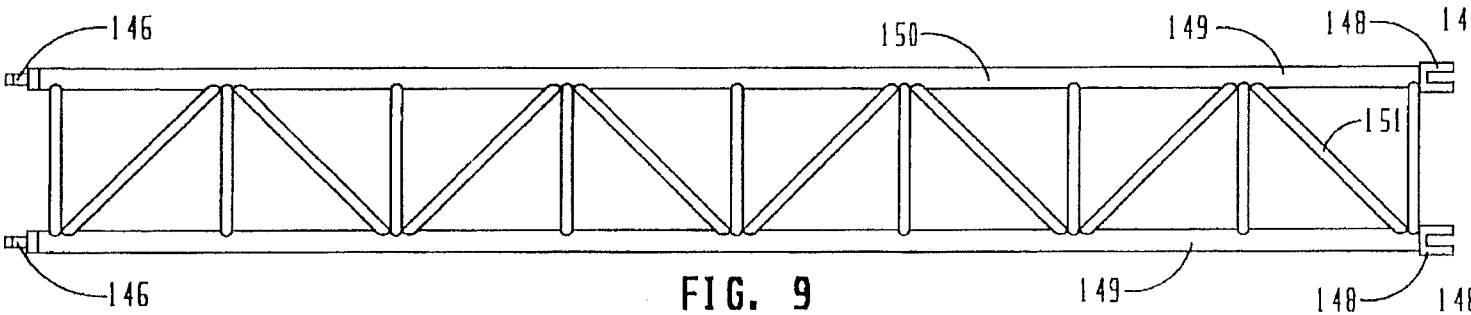
FIG. 9 is a side view of the tower section of FIG. 8.
Figure 8:
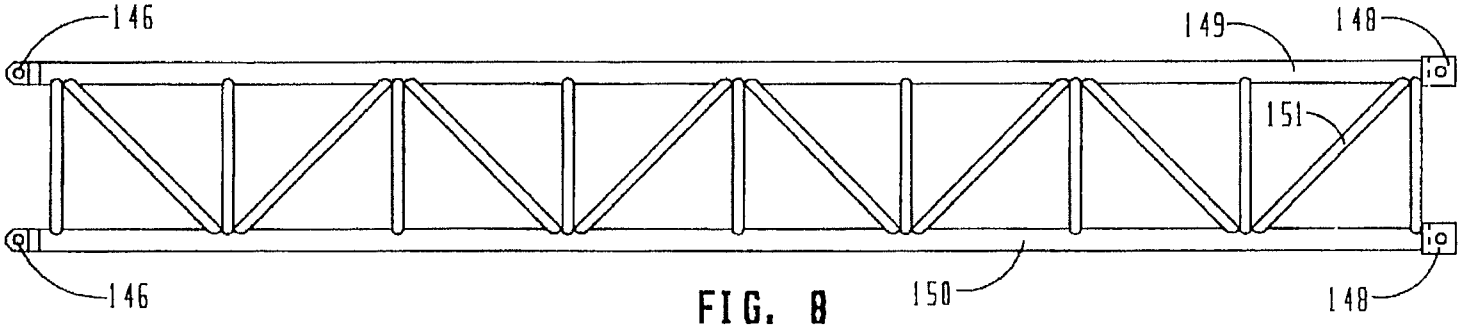
FIG. 8 is a front elevation view of a tower section according to the present invention.
Figure 19:
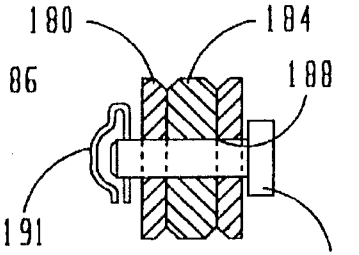
FIG. 19 is a side section view of the assembled male and female clevis connection of FIG. 18.
Figure 18:
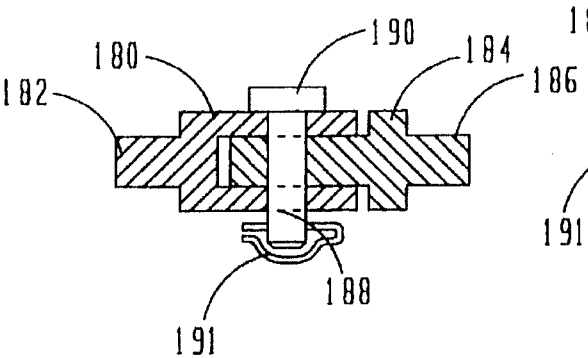
FIG. 18 is a front section view of an assembled male and female clevis connection.

FIGS. 8, 9 and 10 show a front elevation view of a typical tower section 150, a side elevation view of tower section 150, and a plan view, respectively, of a typical tower section 150, according to the invention. Preferably, hollow lengths of steel tubing 149 form corners, while welded cross braces 151 are used to form a strong lightweight tower 150. A plurality of tower sections 150 of selected lengths are connected to form towers 30, 32, 34 and 36. The engagement of towers 30 with the pedestals 22 through female clevis connector portions 144 and male clevis connecting portions 146, shown in FIGS. 8 and 9, are typical for each tower 30, 32, 34 and 36. It will further be understood that the height of each tower 30 can be increased by coupling additional tower sections 150 at clevis connecting portions 148 and 146 of each of the tower sections. In the embodiment shown, clevis connector portions 144 are female portions and the corresponding male connector portions 146. In this arrangement, the opposite end clevis connectors 148 are female connecting portions so that the height of towers 30 can be conveniently adjusted by adding multiple tower sections 150 or different length sections 150 and assembling them one to the next through the use of interconnecting male and female clevis connections (as shown in FIGS. 18 and 19 below) with slip pins 190 inserted at each corner and through each of the clevis connection assemblies. Safety clips 191 are inserted to hold pins 190 in place.

As shown in FIG. 10, the horizontal cross-sectional shape of the tower sections corresponds to the cross-sectional shape of the pedestals. Advantageously, the towers are constructed of steel tubing with welded angled cross braces for uniform strength. Advantageously for the convenience of assembly, and in particular for connection of the head blocks and rigid mechanical connection of the roof truss sections, the shape of each tower looking from the top is preferably square shaped.

In practice it has been found advantageous to determine the height of the towers prior to moving the component tower sections 150 to the desired roof site. The desired lengths of tower sections 150 may be assembled into a plurality of equal height towers and then moved to the site. Where the towers are taller than the normal length of a transport vehicle such as a truck or train, a plurality of shorter subgroups of tower sections can be connected together while the towers are in a horizontal orientation at the site. Each assembled tower can be connected to the pedestal at two of the clevis connectors and then pivoted about the clevis pins upward into a vertical position such that the other two corresponding clevis connectors on the pedestal and on the tower can be quickly and detachably connected using pins 190 inserted through the corresponding clevis portions 144 and 146. Clips 191, or equivalent means for securing clevis pins 190, are used for safety at all clevis connections.

Figure 12:
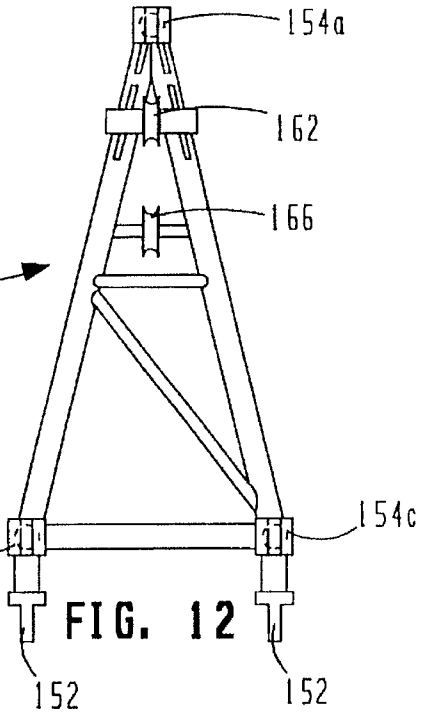
FIG. 12 is a side view of a head block.
Figure 11:
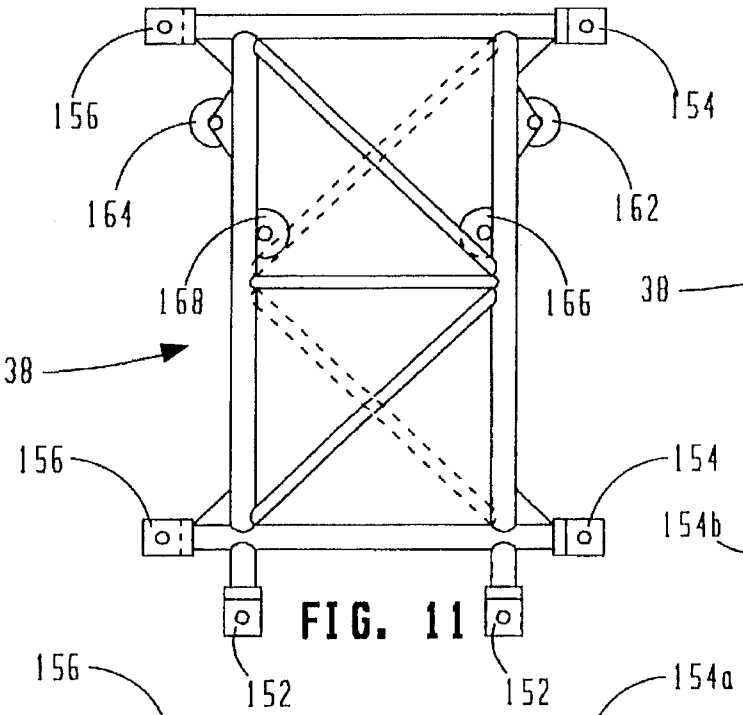
FIG. 11 is a front elevation view of a double head block according to the present invention.
Figure 13:
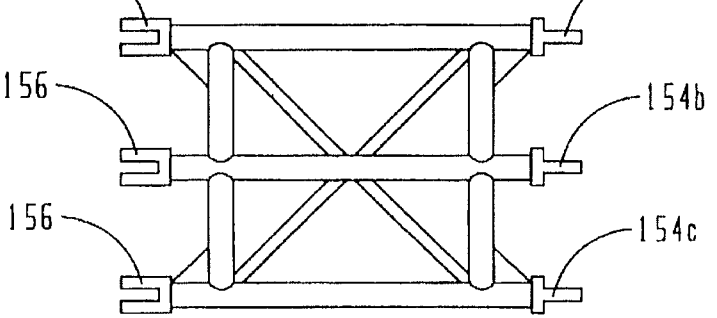
FIG. 13 is a plan view of the double head block of FIG. 11.

FIGS. 11, 12, and 13 are a front elevation view, a side view and a plan view, respectively, of a double head block which will be attached to the upper end of towers 30 and 32 through interconnecting and pinning together of clevis portions 148 with clevis portions 152. While FIGS. 11, 12, and 13 will be described with respect to head block 38, it will be understood that in each position where a double head block is required, i.e., a plurality of head blocks 38 or a plurality of head blocks 40, the engagement and operation thereof will be substantially similar. Head block 38 has male clevis connecting portions 154 extending horizontally and preferably, in a triangular pattern corresponding to a triangular cross-sectional shape of the roof trusses. Conveniently, the three triangularly spaced points of the pattern correspond to corners 154*a, b,* and *c* as shown in FIG. 12. Clevis connecting portions 154 are depicted as male portions. In the opposite horizontal direction, clevis connector portions 156 extend from similar triangularly spaced points or corners of double head block 38. The oppositely directed clevis connecting portions 156 are female clevis connector portions as more clearly shown in FIG. 13. Oppositely directed male and female clevis portions could be used without departing from the invention. As will be more fully understood with reference to FIGS. 15, 16, and 17 below, clevis connectors 154 are designed for engagement with clevis connectors 158 on the horizontal truss sections and clevis connecting portions 156 are designed to connect with male clevis connecting portions 160 on the horizontal roof truss sections.

Also shown in FIGS. 11 and 12 are cable support sheaves 162 on one side of the double head block 38 and cable support sheave 164 on the opposite side. Also depicted are cable guidance sheaves 166 on one side and 168 on the other side which project inwardly into the tower section so that lifting winch cables 80, 82, 100, and 104 are spaced apart from the framework of the tower sections so that rubbing of the winching cables does not occur when the roof assembly is raised into position for a rigid connection between corresponding male and female clevis connector portions on the head blocks and roof trusses.

Figure 14:
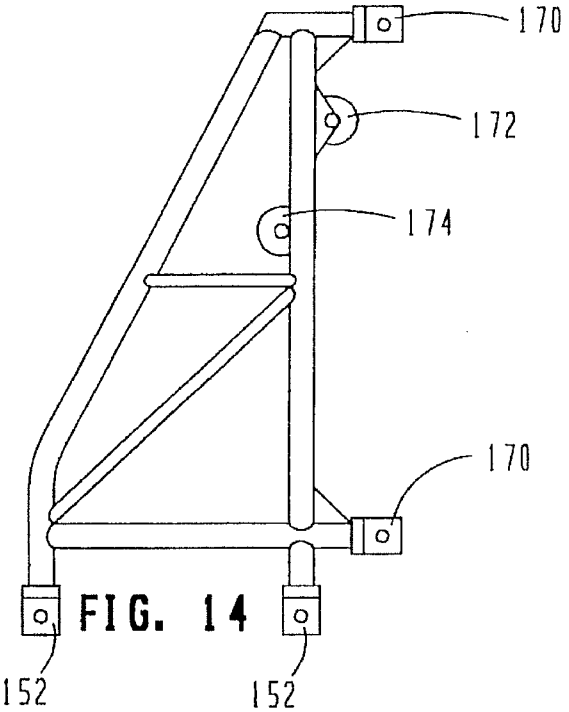
FIG. 14 is a side view of an end head block according to the present invention.

FIG. 14 is a front elevation view of an end head block, for example, a left end head block, which has clevis connector portions 170 extending in one horizontal direction. Clevis connector portions 170 are depicted as male clevis portions. It will be understood that an oppositely directed end head block, or a right end head block, will be positioned with female clevis connection portions in an opposite horizontal direction. Thus, a pair of opposed end head blocks are positioned on left and right towers. The clevis connecting portion on the opposite end head block will be the complementary portion, i.e., the female portion for the configuration shown in FIG. 14. Again, a cable support sheave 172 is depicted and constructed for substantial load bearing capabilities, while a guide sheave 174 is provided to space the cable apart from the head block and tower structure.

Figure 16:
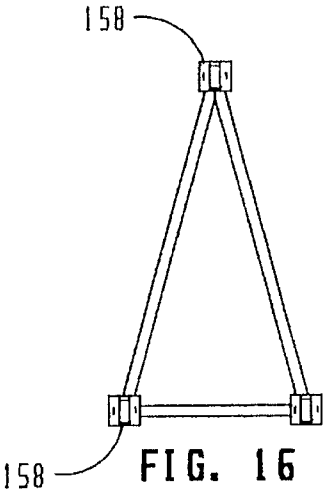
FIG. 16 is a side view of a triangular roof truss section according to the present invention.
Figure 15:
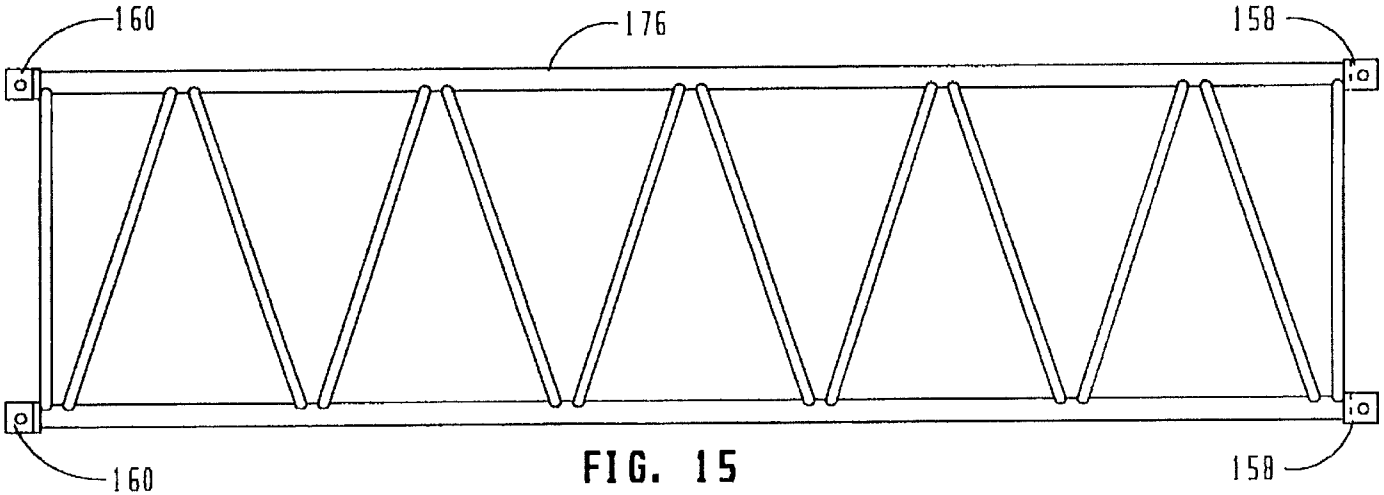
FIG. 15 is a front elevation view of a triangular roof truss section according to the present invention.
Figure 17:
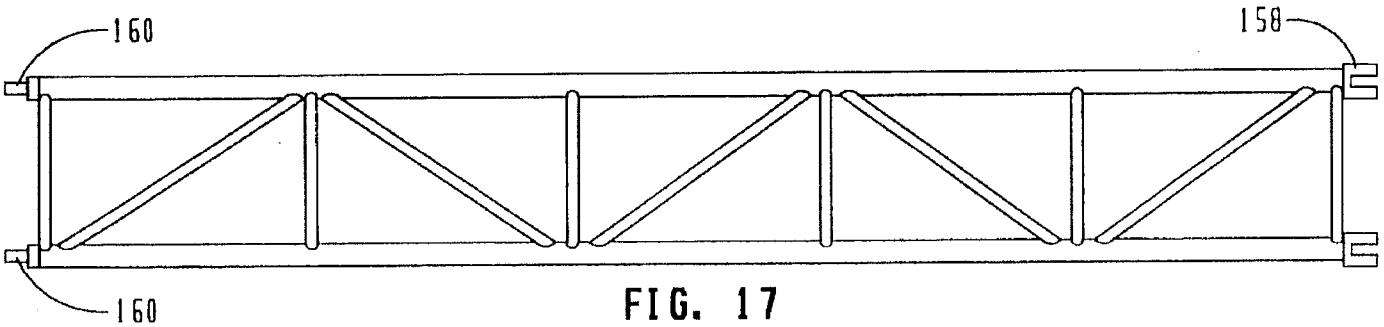
FIG. 17 is a plan view of a triangular roof truss section of FIG. 5.

FIGS. 15, 16 and 17 are a front view, a side view, and a bottom view of a roof truss subsection 176, respectively. Roof truss subsections 176 can be combined with other truss subsections 176 of selected lengths to form any number of a plurality of roof support trusses 52, 54 and 58 having a desired length. Preferably, the roof trusses are formed of steel tubing with welded cross tubes. A similar construction with smaller dimensions may be used for tie beams 90 (FIGS. 2 and 3) or for lighting support trusses 94 (FIG. 3). Aluminum tubing may also be used for lightweight trusses, particularly for lighting support trusses 94. Again, opposite ends of each of the triangular roof support truss subsections has either a male clevis connector portion 158 or a female clevis connector portion 160. It will be seen from the arrangement depicted that the system advantageously provides male and female connectors at opposite ends of each subsection so that convenient construction can be quickly and rapidly made without undue onsite rearranging in order to form rigid connections.

FIGS. 18 and 19 show a standard male/female clevis connection arrangement is shown in a front cross-sectional view in FIG. 18 and in a side cross-sectional view in FIG. 19. The female connector portion 180 has a shaft 182 which may be inserted into an end of a hollow tubing or pipe which forms the structure of pedestals, towers, head blocks and trusses. The clevis portions are securely fastened to the tubing or pipe as by welding. The male portion 184 of the clevis connector similarly has a shaft 186 which is inserted into tubing from which the component parts are constructed and fastened rigidly thereto. Referring to FIG. 19, during assembly the female portion 180 engages the male portion 184 therebetween and a pin 190 is inserted through an orifice 188 extending through both the male and female portion to accomplish rigid mechanical connection. A safety pin 191 is inserted to complete the connection.

Figure 21:
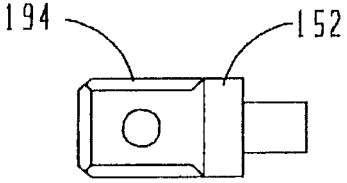
FIG. 21 is a front view of one embodiment of a male clevis portion which is correspondingly complementary to the female clevis portion of FIG. 20.
Figure 20:
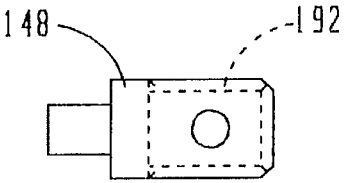
FIG. 20 is a front view of one alternative embodiment of a female clevis portion.

With reference to FIGS. 20 and 21 which show a female portion and a male portion, respectively, of a standard rectangular female clevis portion 148 and male clevis portion 152 of one alternative embodiment of a clevis. It will be seen that at the interconnecting corners the female clevis portion has a chamfer 192 and the male portion has a chamfer 194 to facilitate easy engagement and alignment of the clevises which is important when dealing with substantially long tower sections, truss sections, and the like.

Figure 23:
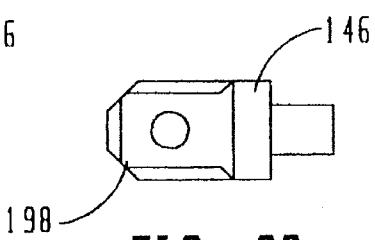
FIG. 23 is a front view of an alternative male clevis portion which is correspondingly complementary to the female clevis portion of FIG. 22 with beveled corners.
Figure 22:
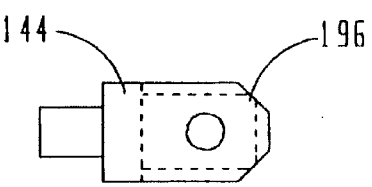
FIG. 22 is a front view of an alternative female clevis portion with beveled corners to facilitate easy connection.

With reference to FIGS. 22 and 23, it will be noted that an alternative embodiment of a female clevis portion 144 is shown in FIG. 22 in which the connection end corners 196 are removed. Similarly, the male portion 146 in the alternative embodiment shown in FIG. 23 has its corners 198 removed. The alternative embodiment shown in FIGS. 22 and 23 is preferably used for connections between pedestals, such as clevis connectors 134 and tower sections such as corresponding clevis connections 146. This facilitates connecting two of the four clevis connectors to each pedestal and tower when the tower is in the substantially horizontal orientation and then pivoting the tower upward about pins 190 engaged through orifices 188 so that the entire tower rotates into a vertical position at which the other two clevis connectors can be moved into position and pinned.

Figure 25:
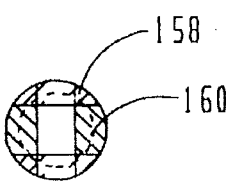
FIG. 25 is a side section view of the assembled circular clevis connection of FIG. 24.
Figure 24:
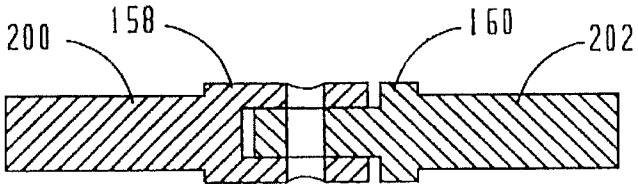
FIG. 24 is a front section view of an assembled circular clevis connection with elongated shafts for improved horizontal loading.

FIG. 24 depicts a front cross-sectional view of an assembled circular male and female clevis connection. FIG. 25 depicts an end cross-sectional view of the clevis connection of FIG. 24. This alternative embodiment for a clevis connector is particularly advantageous for connecting horizontal truss sections 176, such as at female connector 158 and male connector 160 of FIGS. 15 and 17. Each female portion 158 has an elongated connector shaft portion 200 and male portion 160 has a similarly elongated shaft portion 202, both of which are inserted a substantial distance into the tubular frame portions of truss sections 176 and are rigidly attached thereto as by welding. Horizontal bending of the pipe ends is reduced because of the elongated leverage provided by shafts 200 and 202. Also uniquely, the resulting circular cross-section of the clevis connection is advantageously designed to correspond closely to the size of the tubular members of the truss support sections so that circular clamping at any desired position can be conveniently accomplished. This is particularly advantageous when tie beams 90 and lighting supporting trusses 94 need to be affixed to or suspended from the roof truss 52 for purposes of providing a flexible and easily modifiable arrangement of lights, speakers, and the like for facilitating the performance.

Figure 26:
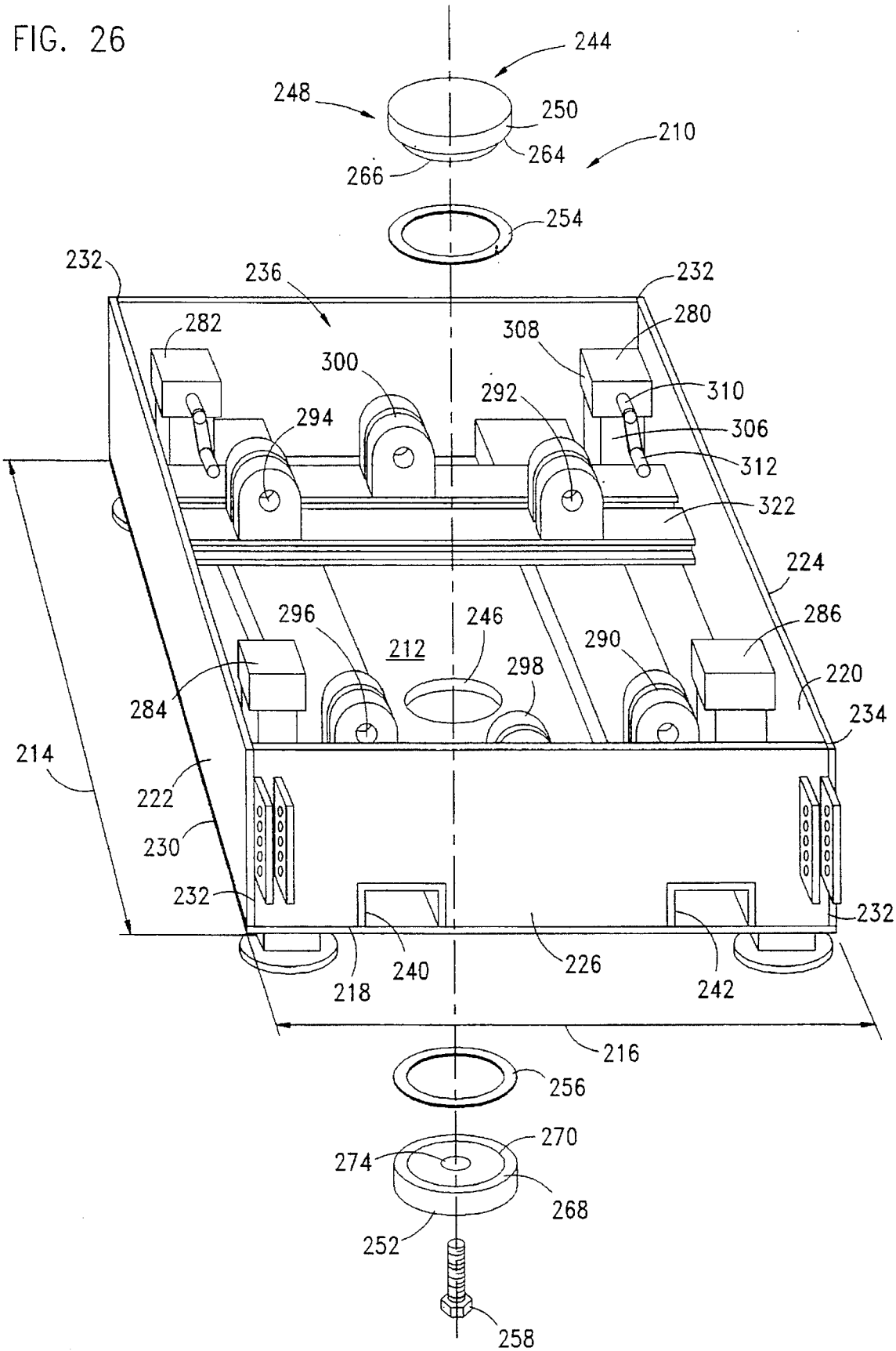
FIG. 26 is a perspective view of one example of a base block with removable ballast according to the present invention.

FIG. 26 shows a schematic perspective view of one alternative embodiment of a base block 210, having removable ballast capabilities. In the preferred embodiment, shown, the base block has a floor 212 which is made of a substantially rigid material, such as a metal plate having dimensions which are shown in this embodiment as side dimension 214 and end dimension 216, which define a perimeter 218 of the base block 210. An upward wall 220 is sealed around the perimeter 218. In the embodiment shown, there is a first side wall 222 and a second side wall 224, as well as a first end wall 226 and a second end wall 228, each of which is welded to the floor 212 to form a bottom seal 230. The side wall-to-end wall abutment seams 232 are similarly welded, forming sealed seams 232 between each side wall and end wall. The walls are preferably coterminous at a top perimeter 234, thereby defining an enclosed volume 236 or a reservoir 236 for holding removable ballast material within the interior of the base block 210.

The base block 210 is preferably provided with forklift channels 240 and 242 by which the base block 210 can be conveniently unloaded and positioned for construction of a tower system. The tower system's base blocks, having side and end dimensions of 6 to 10 ft. or greater and having a depth of 1½ to 3 feet, are useful. The base blocks with removable ballast are advantageously constructed of metal and preferably of steel so that sufficient strength is obtained. Such a base block, even when empty of ballast, has a substantial mass or weight.

The base block structure will be substantially heavier when the reservoir 236 is filled with a ballast material than when empty. Thus, means for convenient removal of the ballast material 244 is uniquely provided. In the preferred embodiment, the ballast material will be a liquid—most preferably water—and the means for removing the ballast material advantageously comprises a drainhole 246 formed in floor 212, as well as a drainplug 248 constructed for insertion into the drainhole 246.

In the embodiment depicted in FIG. 26, the drainplug assembly 248 includes an upper plate 250, a bottom plate 252, an upper compressible seal 254 and a lower compressible seal 256, all of which are sealingly engagable in hole 246. The drainplug 246 is held engaged as with a removable fastener 258. Those skilled in the art will recognize that other types of drainplugs 248 may be used to sealingly engage drainhole 246, such as the use of a threaded plug with corresponding threads formed in drainhole 246 (threads not shown). However, there can be additional difficulty and cost associated with forming such a threaded opening and threaded plug which will reliably seal during repeated uses. Particularly, in the case of threads formed in the floor 212, such threads might easily become damaged during repeated positioning, transport, assembly and disassembly. Thus, it has been found to be advantageous to make a multiple-part plug 248 as depicted for the preferred embodiment.

Figure 27:
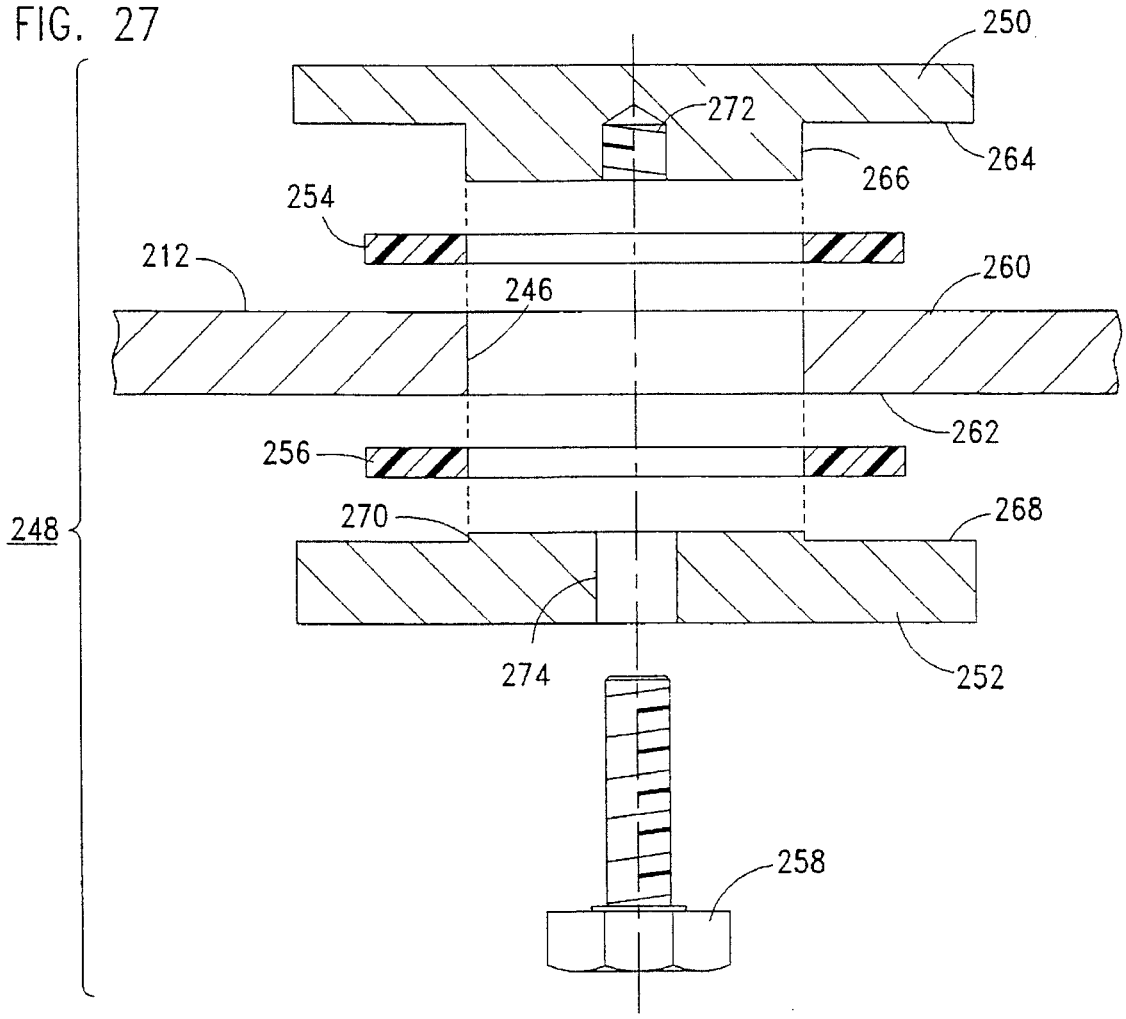
FIG. 27 is a schematic side, cross-sectional view, taken along a plane through a central axis, showing one example of a sealing drain plug for use with a removable ballast base block according to the present invention.

With reference to FIG. 27, which is a schematic side, cross-sectional view taken through a central plane of the plug assembly 248, the details of construction, operation and reliable use of the drainplug 248 will be more fully understood. A portion of floor 212 is depicted, having a drainhole 246 formed therein. The drainhole may be drilled, bored or otherwise formed in a known manner. Floor 212 is a substantially flat plate of steel and desirably has a flat upper surface 260 and a flat lower surface 262 immediately adjacent to the drainhole 246. If the upper and lower surfaces 260 and 262 are not sufficiently flat to provide a seal, then a facing operation may be conducted. However, it has been found that through the use of sealing washers 254 and 256, each washer formed of a durable, resilient rubber or other durably resilient polymer, having a thickness of approximately 1/16 inch normal cold-rolled or hot-rolled plate steel surfaces of a floor 212 can be sealed without resurfacing at 260 and 262. The top plate 250 of the plug assembly 248 desirably has a flat lower surface 264, as well as a projecting boss 266, which boss 266 is sized with a diameter corresponding to the diameter of drainhole 246 for insertion thereinto. Lower plate 252 similarly has an upper flat surface 268 and may be provided with a projecting, locating rim 270 to facilitate rapid alignment of washer 256 and assembly. Top plate 250 has threads 272 formed centrally located in boss 266, and lower plate 252 has a hole 274 formed to allow a threaded fastener to project therethrough. Threaded fastener 258 can therefore be inserted through hole 274 of plate 252 and threaded into the threads 272 of the boss 266 attached to plate 250. In this manner, the upper plate 250 and the lower plate 252 are brought into rigid sealing engagement by compressing sealing washers 254 and 256 against surfaces 260 and 262 of floor 212. Using a separate threaded fastener allows tightening without rotating either top plate 250 or lower plate 252.

When the plug assembly is sealingly fastened therein, the reservoir 236 can be filled with a fluid ballast material 258. In particular, in the preferred embodiment, the seals are completely watertight so that water can be used as the ballast without leaking out of the reservoir 236 after it is filled. As performances for which roof and tower systems are particularly useful are typically conducted within a period of several days of construction, any evaporation of the water will not substantially reduce the weight provided by the ballast.

Figure 28:
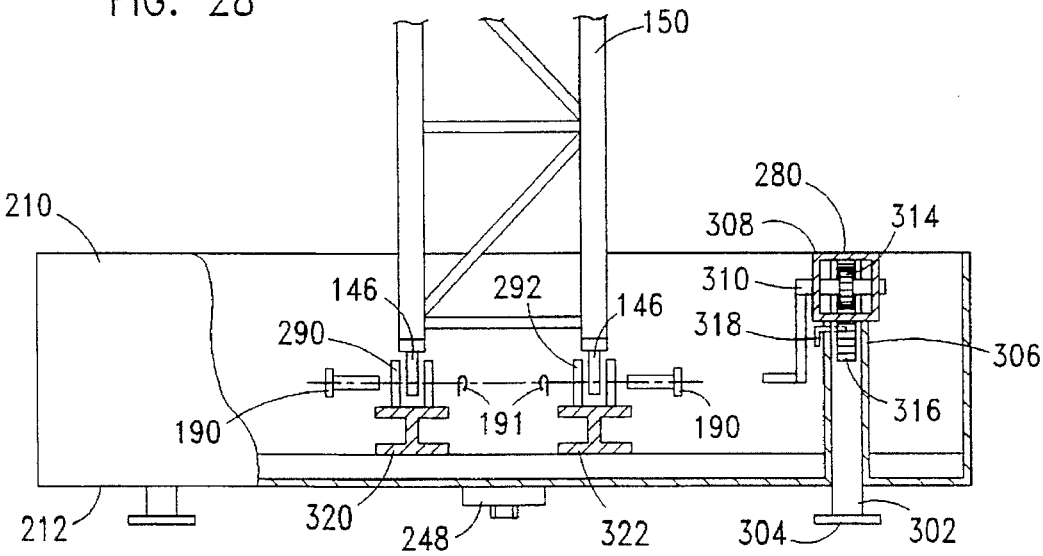
FIG. 28 is a schematic partial cutaway view of a removable ballast base block, depicting an example of a leveling mechanism and the use thereof, as well as attached tower connectors and the use thereof, for constructing a roof and tower system according to the present invention.

Referring to FIG. 28, in conjunction with FIG. 26, additional features of the construction and use of the removable ballast base block 210 can be more fully understood. FIG. 28 depicts a partial cutaway side view of a removable ballast base block 210, having adjustable leveling mechanisms 280, 282, 284 and 286, as well as tower connectors 290, 292, 294 and 296, which are, preferably, removably fastenable clevis connectors for receiving pins 190 secured with clips 191. Alternatively positioned tower connectors, such as connectors 298 and 300, can also be attached to provide additional versatility, as for example for connecting a tower or an arch having two or three lower connectors instead of four, as in the preferred embodiment.

Leveling mechanisms 280, 282, 284 and 286 are preferably placed at each corner of the base block so that leveling in all directions can be accomplished. However, it will be understood that a similar concept with three support legs could be used in which one or all of the legs could be adjustable, without departing entirely from the invention.

The operation and construction will be described in connection with leveling mechanism 280, which is shown in FIG. 28 in partial cutaway cross-sections depicting a leg 302 and a foot 304 which provides surface contact with sufficient surface area to provide stable contact with the onsite ground surface. Preferably, an attached rigid steel plate may be used to provide the desired footing. The leg 302 extends upward through a sealed tubing 306, which connects with a level adjustment housing 308. Within the housing 308, there is a crankshaft 310 which may have a handle 312 for manual adjustment, as in the preferred embodiment depicted in FIG. 28. Alternatively, for example, another type of leveling mechanism, such as a motorized leveling drive (not shown) might be used, although a durable hand-operated crank mechanism is preferred. The crankshaft 310 is interconnected with a length adjusting mechanism, such as a gear drive 314, which engages a rack 316 formed in or fastened to the leg 302. The gear drive 314 and rack are operated with the crankshaft to move the leg upward and downward. A ratchet mechanism 318, or other leg position locking mechanism 318, is provided to keep the leg in the desired adjusted position, once established. One type of leveling mechanism and support leg which can be used for this construction is a semi-trailer leg assembly or "trailer landing gear", available from many truck trailer manufacturers, such as Fruehauf Trailer Corporation.

A level (not shown) may be used, so that the tower connectors are adjusted to a level position for receiving and engaging with a lower end of a tower section. Such a tower section 150, having tower connectors 146, is shown, for example, in FIGS. 8 and 9. Tower connectors 290 and 292, as well as the other tower connectors are preferably attached to rigid cross-support beams 320 and 322, which support beams extend laterally across the floor 212 to provide adequate support for a tower connected thereto. Cross support beams 320 and 322 may also advantageously interconnect with inverted steel channels 240 and 242, which may be used to construct the forklift channels.

Thus, the base block 210 is constructed with all of its connectors and mechanisms below the upper surface so that a stage or other structure can be conveniently constructed thereover without interference from the mechanism of the base block. Also, it is noted that the housing 308 and the extension tubing 306 are rigidly attached and sealed, as by welding, so that water ballast 238 filled inside of the base block 210 will not leak. Connector pins, such as those depicted in FIG. 19, such as pin 190, can be used to connect the tower section mating connectors 146 to correspondingly located female connectors 290, 292, 294 and/or 296 at the base block 210. This structure allows the towers to be connected directly to the base block without the additional use of an interposed pedestal, as with other alternative embodiments. However, pedestals can continue to be used, if desired, because the connectors 290, 292, 294 and 296 are affixed on each base block in a consistent position for any size of tower system.

Figure 29:
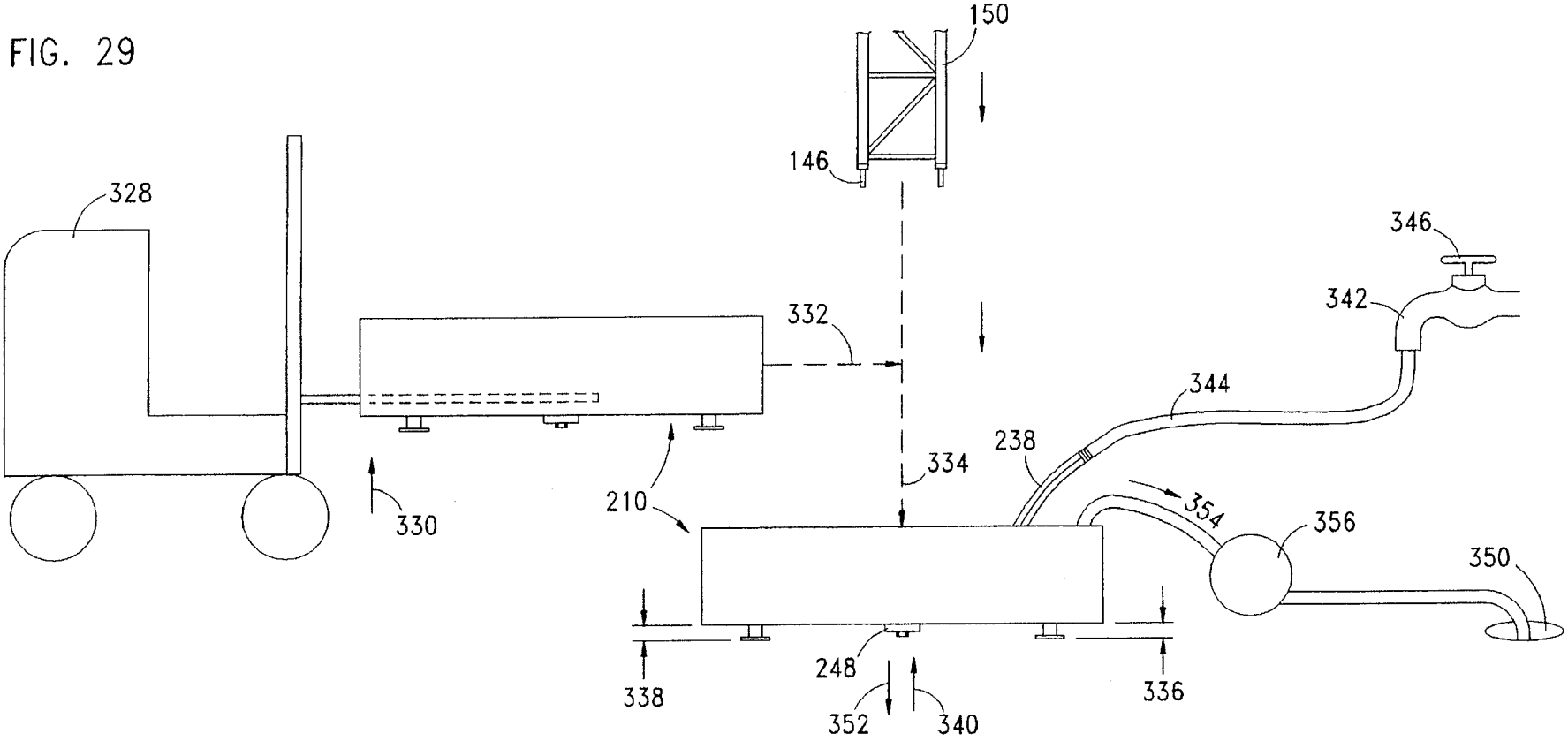
FIG. 29 is a schematic representation of a method of placement, leveling, filling and subsequent draining of a base block with a removable liquid ballast according to one embodiment of the present invention.

With reference to FIG. 29, the complete system and method of use can be more fully understood. At step 330, a forklift or other vehicle 328 is used to lift base block 210, as indicated schematically by the step indicating arrow 330. Forklift 338 is then operated to move the base block 210 into a desired position, as indicated schematically with arrows 332 and 334. Once the base block is set in the desired or predetermined position, then the base block 210 is leveled, as indicated at leveling steps 336 and 338. When the base block 210 is positioned and leveled, as desired, the drainplug 248 is also sealingly secured in drainhole 246, thereby sealing the interior volume or the reservoir 236 of the base block 210, as indicated schematically at arrow 340. With the plugging mechanism 248 sealed in a watertight fashion, a source 342 of water for use as ballast 238, such as a local hydrant or faucet 342, is conveniently accessed as with conduit 344, such as a waterhose 344. The hydrant 342 is turned on as at 346, and water 238 is directed from nozzle 348 into the interior volume 236 of the base block 210, thereby providing ballast which is also conveniently removable. The weight of the ballast can be calculated on the basis of at the rate of approximately eight pounds per gallon of water. A transportable base block, having a volume in gallons of water which weigh several thousand pounds, can be easily constructed according to this invention.

After a performance or a series of performances is completed and the tower system is disassembled, the drainplug 248 is simply removed, as indicated at step 352, thereby draining all of the water to remove the ballast. Of course, in situations where draining facilities are inadequate, the water can be pumped, as indicated at step 354, for removal through a pipe or hose 356 and then to an appropriate drain facility 358.

While the invention has been described in connection with preferred embodiments, it is not intended to limit the scope of the invention to the particular form or forms set forth, but on the contrary, it is intended to cover such alternatives, modifications, and equivalents as may be included within the spirit and scope of the invention as defined by the appended claims.

What is claimed is:

1. A portable tower construction system of the type for building, disassembling, moving and reassembling a tower at an intended site from component pieces, comprising:

(a) a pair of base blocks positionable at a predetermined location at the intended site;

(b) a pair of towers removably fastenable to, and having tops vertically extending upwardly from, said pair of base blocks;

(c) a pair of triangular head block sections removably fastenable at said tops of said pair of towers; and (d) a triangular roof truss constructable on-site at platform level between said pair of opposed base blocks, with said roof aligned between said pair of towers and liftable upwardly via a pair of cable winches and which triangular truss is removably fastenable to said triangular head blocks with pinned male and female connection devices.

2. A portable tower construction system as in claim 1, wherein said pair of base blocks further comprise:

(a) a floor having predetermined dimensions defining a periphery thereof;

(b) a perimeter wall sealingly attached and extending upwardly a predetermined distance around said periphery of said floor, so that an enclosed ballast reservoir is formed; and (c) tower connectors rigidly affixed to said base block at predetermined positions for mating removable engagement with said tower.

3. A portable roof construction system as in claim 2 wherein said tower connectors comprise matingly engageable male and female clevis pin connections, one rigidly fastened to said tower and another rigidly fastened to said base block at said predetermined positions for mating removable engagement.

4. A portable roof construction system of the type for building, disassembling, moving and reassembling a roof at an intended site from component pieces, comprising:

(a) a plurality of movable pairs of base blocks positionable at predetermined regular spaced apart locations at the intended site;

(b) a plurality of tower pairs removably fastenable to, and having tops vertically extending upwardly from, said plurality of base block pairs;

(c) a plurality of pairs of triangular head block sections removably fastenable at said tops of said plurality of tower pairs; and (d) a roof assembly comprising a plurality of triangular roof trusses constructable on-site at platform level between a plurality of opposed pairs of said plurality of base blocks, with each of said plurality of roof trusses aligned between opposed pairs of said towers and liftable upwardly via a plurality of cable winches and which triangular truss sections are removably fastenable to said triangular head blocks with pinned male and female devices.

5. A portable roof system as in claim 4, wherein each of said plurality of movable pairs of base blocks includes two base blocks, each comprising:

(a) a floor, having dimensions defining a periphery;

(b) a perimeter wall extending upwardly around said periphery of said floor and sealingly attached thereto, thereby defining an enclosed ballast reservoir; and (c) tower connectors rigidly affixed to said base block at predetermined locations for mating engagement with one tower of each of said plurality of tower pairs.

6. A portable roof system as in claim 5, wherein said tower connectors comprise matingly engageable male and female clevis pin connections, one rigidly fastened to said tower and another rigidly fastened to said base block at said predetermined positions for mating removable engagement.

7. A stage roof of the type for building, disassembling, moving, and reassembling a stage roof at an intended site to cover a stage platform, comprising:

(a) a plurality of movable base blocks positioned at predetermined regular locations at the intended site to form a plurality of opposed pairs of base blocks spaced apart a predetermined uniform distance;

(b) a plurality of opposed tower pairs having bottoms removably fastened to said plurality of pairs of base blocks and having tops vertically extending upwardly therefrom;

(c) a plurality of opposed pairs of head block sections removably fastened at said tops of said plurality of opposed tower pairs;

(d) a roof assembly comprising a plurality of roof trusses between said plurality of opposed tower pairs, with each of said plurality of roof trusses having opposite ends thereof aligned between opposed pairs of said towers;

(e) a plurality of cable winches for lifting said plurality of roof trusses upwardly into alignment between said opposed pairs of head blocks; and (f) corresponding clevis pin connection devices affixed to said ends of said trusses and to said head blocks removably pinned to form a rigid mechanical connection between said plurality of head block pairs and said plurality of trusses.

8. A stage roof, as in claim 7, wherein each base block of said plurality of base blocks further comprises:

a) a floor;

(b) a periphery wall, sealingly attached to said floor and projecting upwardly therefrom, defining an enclosed ballast reservoir therein; and (c) tower connectors, rigidly affixed to said base block at predetermined positions for engagement with one of said plurality of tower sections.

9. A method of constructing a portable roof and tower system at an intended site comprising the steps of:

(a) positioning a plurality of movable base blocks at predetermined regular locations to form a plurality of aligned uniformly spaced apart pairs of base blocks;

(b) removably fastening a plurality of towers to said plurality of base blocks, so that tops of said towers extend vertically upward from said plurality of base blocks to form a plurality of aligned separated pairs of towers with tops;

(c) removably fastening a plurality of head blocks at said tops of said towers to form a plurality of uniformly spaced apart head block pairs, said head blocks having male or female removable pinnable clevis devices attached in a predetermined arrangement;

(d) assembling a covered roof having a plurality of roof trusses between said uniformly spaced apart pairs of towers, each roof truss having opposite ends with a male or female portion of a pinnable clevis device attached thereto in a predetermined arrangement corresponding to said predetermined arrangement of pinnable clevis devices on said head blocks;

(e) lifting said assembled covered roof upwardly with cable winches supported from said head blocks until said roof trusses are aligned between said uniformly spaced apart head block pairs so that said male or female portions of said pinnable clevis devices are aligned for engagement; and (f) removably fastening said roof trusses to said head blocks by rigidly pinning together said male and female portions of said pinnable clevis devices on said head blocks and said roof trusses.

10. A method of constructing a portable roof and tower system, as in claim 9, further comprising the step of filling said plurality of movable base blocks with a removable ballast material after positioning.

* * * * *